US010004256B2

(12) United States Patent
Tritz et al.

(10) Patent No.: US 10,004,256 B2
(45) Date of Patent: Jun. 26, 2018

(54) SMOKING ARTICLE COMPRISING MENTHOL

(71) Applicant: PHILIP MORRIS PRODUCTS S.A., Neuchatel (CH)

(72) Inventors: Dorothy Tritz, Yverdon-les-Bains (CH); Charles Kuersteiner, Jouxtens-Mezery (CH); Yves Jordil, Lugrin (FR); Andrea Cecchetto, Liebfeld (CH)

(73) Assignee: Philip Morris Products S.A., Neuchatel (CH)

( * ) Notice: Subject to any disclaimer, the term of this patent is extended or adjusted under 35 U.S.C. 154(b) by 538 days.

(21) Appl. No.: 14/356,688

(22) PCT Filed: Nov. 6, 2012

(86) PCT No.: PCT/EP2012/071910
§ 371 (c)(1),
(2) Date: May 7, 2014

(87) PCT Pub. No.: WO2013/068337
PCT Pub. Date: May 16, 2013

(65) Prior Publication Data

US 2014/0326259 A1 Nov. 6, 2014

(30) Foreign Application Priority Data

Nov. 7, 2011 (EP) ..... 11250887

(51) Int. Cl.
*A24D 3/06* (2006.01)
*A24D 3/04* (2006.01)

(52) U.S. Cl.
CPC ..... *A24D 3/061* (2013.01); *A24D 3/04* (2013.01)

(58) Field of Classification Search
CPC ..... A24D 3/061; A24D 3/04; A24D 3/18
See application file for complete search history.

(56) References Cited

U.S. PATENT DOCUMENTS 3,370,592 A * 2/1968 Schultz ..... A24D 3/04 131/334
4,570,649 A * 2/1986 Nichols ..... A24D 3/041 131/336

(Continued)

FOREIGN PATENT DOCUMENTS

CN 101873810 10/2010
CN 101938918 1/2011

(Continued)

OTHER PUBLICATIONS

PCT International Search Report and Written Opinion for International Application No. PCT/EP2012/071910 dated Mar. 19, 2013 (9 pages).

(Continued)

*Primary Examiner* — Michael J Felton
*Assistant Examiner* — Jerzi H Moreno Hernandez
(74) *Attorney, Agent, or Firm* — Mueting, Raasch & Gebhardt, P.A.

(57) ABSTRACT

A smoking article (10, 20) comprises a flavor release segment (12). The flavor release segment (12) comprises a plug of fibrous material circumscribed by a substantially air impermeable wrapper and a plurality of solid menthol particles distributed within the plug of fibrous material. The fibrous material comprises randomly oriented fibers. Preferably the smoking article (10, 20) comprises a mouthpiece (4), wherein the mouthpiece (4) comprises the flavor release segment (12).

16 Claims, 1 Drawing Sheet

(56) References Cited

U.S. PATENT DOCUMENTS

Figure 1:
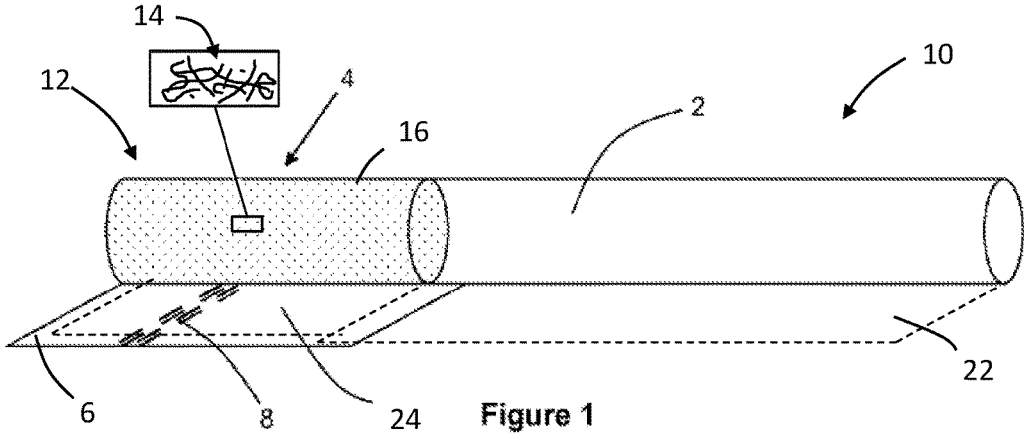

| | | | | |
|---|---|---|---|---|
| 4,889,143 | A * | 12/1989 | Pryor | A24B 3/14 131/331 |
| 5,396,909 | A * | 3/1995 | Gentry | A24D 3/04 131/332 |
| 6,718,989 | B1 * | 4/2004 | Clarke | A24D 3/04 131/339 |
| 6,772,768 | B2 | 8/2004 | Xu | |
| 2002/0031651 | A1 * | 3/2002 | Mallory | B32B 27/32 428/213 |
| 2002/0062833 | A1 * | 5/2002 | Xue | A24D 3/064 131/331 |
| 2007/0215168 | A1 * | 9/2007 | Banerjee | A24B 15/165 131/335 |
| 2007/0261706 | A1 * | 11/2007 | Banerjea | A24D 3/163 131/342 |
| 2008/0173320 | A1 * | 7/2008 | Dunlap | A24D 1/00 131/365 |
| 2008/0230079 | A1 | 9/2008 | Besso | |
| 2008/0279947 | A1 * | 11/2008 | Nowak | A61K 8/25 424/489 |
| 2008/0314401 | A1 | 12/2008 | McLaughlin | |
| 2009/0044817 | A1 | 2/2009 | Besso | |
| 2009/0053513 | A1 * | 2/2009 | Enzinger | B29C 55/023 428/339 |
| 2009/0235941 | A1 * | 9/2009 | Chida | A24B 15/283 131/275 |
| 2010/0006112 | A1 | 1/2010 | Yang | |
| 2011/0023900 | A1 * | 2/2011 | Clarke | A24D 3/0208 131/332 |
| 2011/0036367 | A1 * | 2/2011 | Saito | A24B 15/165 131/332 |
| 2011/0088704 | A1 * | 4/2011 | Lipowicz | A24D 1/00 131/88 |
| 2011/0120481 | A1 * | 5/2011 | Besso | A24D 3/0212 131/275 |
| 2014/0224268 | A1 * | 8/2014 | Ryter | A24D 3/045 131/332 |

FOREIGN PATENT DOCUMENTS

| | | | | |
|---|---|---|---|---|
| EP | 0093478 | | 3/1986 | |
| GB | 2145918 | | 4/1985 | |
| JP | S52-132122 | | 11/1977 | |
| JP | S59-196082 | | 11/1984 | |
| JP | H07203934 | | 8/1995 | |
| JP | 2010-521962 | | 7/2010 | |
| JP | 2010-536336 | | 12/2010 | |
| JP | 2011-509682 | | 3/2011 | |
| RU | 2008/123265 | | 1/2010 | |
| WO | WO 2006/082161 | | 8/2006 | |
| WO | WO 2007/010407 | | 1/2007 | |
| WO | WO 2008/121610 | | 10/2008 | |
| WO | WO 2008/146161 | | 12/2008 | |
| WO | WO 2009/022232 | | 2/2009 | |
| WO | WO 2009/080368 | | 7/2009 | |
| WO | WO 2009/093051 | | 7/2009 | |
| WO | WO 2009-157240 | | 12/2009 | |
| WO | WO 2010/107613 | | 9/2010 | |
| WO | WO 2011/042174 | | 4/2011 | |
| WO | WO 2011/077138 | | 6/2011 | |
| WO | WO 2012080174 | A1 * | 6/2012 | A24D 3/048 |
| WO | WO 2013034652 | A1 * | 3/2013 | A24D 3/045 |

OTHER PUBLICATIONS

European Search Report for Application No. 11250887.4-2313 (5 pages).

Notice of Allowance issued by the Kazakhstan Patent Office for Application No. 2014/1607.1, dated Sep. 25, 2015 (6 pages).

Office Action issued in Russia for Application No. 201412355 dated Apr. 25, 2017 (11 pages). English translation included.

Office Action in China for Application No. 201280054555.3 dated Aug. 19, 2016 (17 pages). English translation included.

Office Action issued in Japan for Application No. 2014-540419 dated Sep. 5, 2016 (6 pages). English translation included.

Office Action issued in Russia for Application No. 2014123355 dated Sep. 5, 2016 (7 pages). English translation included.

Office Action issued in Japan for Application No. 2014-540419 dated Aug. 16, 2017 (6 pages). English translation included.

* cited by examiner

SMOKING ARTICLE COMPRISING MENTHOL

This application is a U.S. National Stage Application of International Application No. PCT/EP2012/071910, filed Nov. 6, 2012, which was published in English on May 16, 2013, International Patent Publication WO 2013/068337 A1. International Application No. PCT/EP2012/071910 claims priority to European Application No. 11250887.4 filed Nov. 7, 2011.

The present invention relates to a smoking article comprising a flavour release segment capable of delivering menthol into the mainstream smoke or aerosol of the smoking article. The present invention also relates to a mouthpiece for a smoking article comprising such a flavour release segment.

Filter cigarettes typically comprise a rod of tobacco cut filler circumscribed by a paper wrapper and a cylindrical filter aligned in end-to-end relationship with the wrapped tobacco rod. The filter is generally attached to the wrapped tobacco rod by a band of tipping paper, which circumscribes the filter and an adjacent portion of the wrapper tobacco rod. Ventilation in the form of circumferential perforations in the band of tipping paper is commonly provided at a location along the filter, to mix the mainstream smoke produced during combustion of the wrapped tobacco rod with ambient air.

In conventional filter cigarettes, the filter commonly consists of a single segment of filtration material, typically cellulose acetate tow, circumscribed by porous plug wrap. Filter cigarettes with multi-component filters that comprise two or more segments for the removal of particulate and gaseous components of the mainstream smoke are also known.

A number of smoking articles in which tobacco is heated rather than combusted have also been proposed in the art. In heated smoking articles, an aerosol is generated by heating a flavour generating substrate, such as tobacco. Typically in heated smoking articles, an aerosol is generated by the transfer of heat from a heat source, for example a chemical, electrical or combustible heat source, to a physically separate aerosol-generating substrate, which may be located within, around or downstream of the heat source. During smoking, volatile compounds are released from the aerosol generating substrate by heat transfer from the heat source and entrained in air drawn through the smoking article. As the released compounds cool they condense to form an aerosol that is inhaled by the consumer.

To enhance or modify the flavour of the mainstream smoke or aerosol, it is known to provide smoking articles with single and multi-segment filters that include flavourants, such as menthol. Menthol may be incorporated in the filter, wrapped tobacco rod or aerosol-generating substrate of smoking articles in liquid form using a suitable liquid carrier. Liquid forms of menthol are volatile and therefore tend to migrate or evaporate from smoking articles during storage. The amount of menthol available to flavour the mainstream smoke or aerosol during smoking is therefore disadvantageously reduced.

Furthermore, when menthol in liquid form is incorporated in a segment of cellulose acetate tow in the filter of a smoking article the cellulose acetate tow acts like a sorbent. This also disadvantageously reduces the amount of menthol released into mainstream smoke or aerosol drawn through the filter during smoking.

It would be desirable to provide means for improving menthol delivery to a consumer. In particular, it would be desirable to provide means for delivering high levels of menthol into the mainstream smoke or aerosol of a smoking article as it is drawn through the filter or mouthpiece of the smoking article.

It would also be desirable to provide means for delivering menthol into the mainstream smoke or aerosol of a smoking article that reduces loss of flavour prior to smoking, for example during storage of the smoking article.

According to the invention there is provided a smoking article comprising a flavour release segment, wherein the flavour release segment comprises a plug of fibrous material circumscribed by a substantially air impermeable wrapper and a plurality of solid menthol particles distributed within the plug of fibrous material, wherein the fibrous material comprises randomly oriented fibres.

According to the invention there is also provided a smoking article comprising a mouthpiece comprising a flavour release segment, wherein the flavour release segment comprises a plug of fibrous filtration material circumscribed by a substantially air impermeable wrapper and a plurality of solid menthol particles distributed within the plug of fibrous material, wherein the fibrous material comprises randomly oriented fibres.

According to the invention there is further provided a mouthpiece for a smoking article comprising a flavour release segment, wherein the flavour release segment comprises a plug of fibrous material circumscribed by a substantially air impermeable wrapper and a plurality of solid menthol particles distributed within the plug of fibrous material, wherein the fibrous material comprises randomly oriented fibres.

According to the invention there is also provided a flavour release segment for a smoking article comprising a plug of fibrous material circumscribed by a substantially air impermeable wrapper and a plurality of solid menthol particles distributed within the plug of fibrous material, wherein the fibrous material comprises randomly oriented fibres.

In the following description, any references to features or properties of flavour release segments according to the invention also apply to flavour release segments of mouthpieces and smoking articles according to the invention, unless stated otherwise.

As used herein, the term 'plug' denotes a generally cylindrical element having a substantially circular, oval or elliptical cross-section. In the following description, the term 'plug' is used to describe generally cylindrical elements of any length.

As used herein, the term 'length' denotes the dimension in the longitudinal direction of flavour release segments, mouthpieces and smoking articles according to the invention.

As used herein, the term 'menthol' denotes the compound 2-isopropyl-5-methylcyclohexanol in any of its isomeric forms.

As used herein, the term 'particles' is used to describe granular and particulate solid materials having any suitable form including, but not limited to, powders, crystals, granules, needles, flakes, pellets, and beads.

The term 'solid menthol particles' is used to describe any granular or particulate solid material comprising at least about 80% menthol by weight.

As used herein, the term 'randomly-oriented fibres' denotes woven and non-woven fibers that are oriented in various directions and that are not substantially aligned in the longitudinal direction of the flavour release segment. The randomly oriented fibres in the plug of fibrous material of the flavour release segment according to the invention are preferably pre-cut and extend only part way along the length of the plug of fibrous material.

Smoking articles according to the invention may be in the form of filter cigarettes or other smoking articles in which tobacco cut filler or other smokable material is combusted to form smoke. The invention additionally encompasses smoking articles in which tobacco material or another aerosol-generating substrate is heated to form an aerosol rather than combusted and smoking articles in which an aerosol, in particular a nicotine-containing aerosol, is generated from a tobacco material, tobacco extract, or alternative nicotine source or another aerosol generating substrate, without combustion or heating.

In the following description, the term 'mainstream smoke' is used to describe both mainstream smoke produced by combustible smoking articles, such as filter cigarettes, and mainstream aerosols produced by non-combustible smoking articles, such as heated or non-heated smoking articles of the types described above.

In use, menthol contained in the plurality of solid menthol particles distributed within the plug of fibrous material of the flavour release segment according to the invention is released into mainstream smoke drawn through the flavour release segment.

The use of solid menthol particles in flavour release segments according to the invention, rather than menthol in liquid form, avoids sorption of menthol by the fibrous material. This advantageously results in greater release of menthol into mainstream smoke drawn through the flavour release segment.

The use of solid menthol particles in flavour release segments according to the invention, rather than menthol in liquid form, also reduces loss of menthol prior to use, for example during storage. This also advantageously results in significantly greater release of menthol into mainstream smoke drawn through the flavour release segment.

The use of randomly oriented fibres in the plug of fibrous material of flavour release segments according to the invention enables a high loading of solid menthol particles in the plug to be achieved. This advantageously enables flavour release segments according to the invention to deliver high amounts of menthol into mainstream smoke.

The combination of a high loading of solid menthol particles in flavour release segments according to the invention and greater release of menthol from the solid menthol particles enables desired menthol deliveries to be achieved using shorter flavour release segments. This advantageously provides greater flexibility in the design of mouthpieces for smoking articles comprising flavour release segments according to the invention.

To reduce loss of menthol from the plurality of solid menthol particles distributed in the plug of fibrous material, flavour release segments according to the invention are circumscribed by a substantially air impermeable wrapper. This is particularly advantageous in view of the high loading of solid menthol particles that may be achieved through the use of randomly oriented fibres in the plug of fibrous material of flavour release segments according to the invention.

The substantially air impermeable wrapper may be a substantially air impermeable paper wrapper or a substantially air impermeable film wrapper.

Where the substantially air impermeable wrapper is a substantially air impermeable paper wrapper, the substantially air impermeable paper wrapper preferably has an air permeability of less than about 20 Coresta units' more preferably less than about 10 Coresta units, most preferably less than about 5 Coresta units as measured in accordance with ISO 2965:2009.

The air permeability in Coresta units is the amount of air in cubic centimeters that passes through one square centimeter of the wrapper in one minute at a constant pressure difference of one kilopascal (that is, 1 Coresta unit corresponds to an air permeability of 1 $cm^3/min \cdot cm^2$ at a pressure differential of 1 kPa).

Where the substantially air impermeable wrapper is a substantially air impermeable film wrapper, the substantially air impermeable film wrapper preferably has an oxygen gas transmission rate ($O_2GTR$) of less than about 5 $cm^3$ (STP)/$m^2 \cdot 24$ hours at a pressure differential of 1 atmosphere as measured in accordance with ASTM F1297-07 at 23° C. and 0% relative humidity (RH).

To enable a consumer to see the plurality of solid menthol particles distributed in the plug of fibrous material, flavour release segments according to the invention may be circumscribed by a substantially air impermeable wrapper that is transparent. For example, flavour release segments according to the invention may be circumscribed by a non-porous, air impermeable transparent cellulosic film wrapper.

Flavour release segments according to the invention comprise a plug of fibrous filtration material, wherein the fibrous material comprises randomly oriented fibres, The randomly oriented fibres may be made from any suitable material or materials including, but not limited to, tobacco, cellulose, cellulose acetate and other cellulose derivates, bioplastics, polyvinyl alcohol (PVOH), polylactide (PLA).

Preferably, flavour release segments according to the invention comprise a plug of fibrous filtration material, wherein the fibrous filtration material comprises randomly oriented fibres. More preferably, flavour release segments according to the invention comprise a plug of randomly oriented cellulose acetate fibres.

Plugs of cellulose acetate tow and other fibrous filtration material for use in filters and other mouthpieces for smoking articles commonly include plasticisers such as, for example triacetin, propylene glycol (PG), and polyethylene glycol (PEG).

To avoid dissolution of the plurality of solid menthol particles distributed in the plug of fibrous filtration material, flavour release segments according to the invention preferably comprise plugs of fibrous filtration material that are substantially free of plasticiser.

Flavour release segments according to the invention may comprise any number of solid menthol particles distributed within the plug of fibrous material that is suitable to provide menthol flavour enhancement to mainstream smoke drawn through the flavour release segment.

Preferably, flavour release segments according to invention comprise an average of at least about 0.1 milligrams of solid menthol particles distributed within the plug of fibrous material per millimeter length thereof.

Flavour release segments according to invention may comprise, for example, an average of between about 0.1 milligrams and about 1 mg of solid menthol particles distributed within the plug of fibrous filtration material per millimeter length thereof.

Preferably, the plurality of solid menthol particles is substantially evenly distributed in the plug of fibrous material.

Preferably, the solid menthol particles comprise at least about 90% menthol by weight, more preferably at least about 95% menthol by weight.

Preferably, the (−)-menthol isomeric form of menthol comprises at least about 80% by weight of the total menthol content of the solid menthol particles. More preferably, the (−)-menthol isomeric form comprises at least about 90% by weight of the total menthol content of the solid menthol particles. Most preferably the (−)-menthol isomeric form comprises at least about 95% by weight of the total menthol content of the solid menthol particles The solid menthol particles may contain natural menthol or synthetic menthol or mixtures thereof. Natural menthol for use in the invention may be obtained by, for example, extraction from sources such as *Mentha piperita, Mentha spicata*, or *Mentha arvensis*. Extraction may be performed using known techniques, typical examples being solvent extraction or crystallizing out followed by centrifugation. Synthetic menthol for use in the invention may, for example, be prepared from pulegone as a starting material using a well known reaction.

The solid menthol particles may comprise crystalline menthol or amorphous menthol or mixtures thereof. Preferably, flavour release segments according to the invention comprise a plurality of solid menthol particles comprising crystalline menthol. Preferably, flavour release segments according to the invention comprise a plurality of waxy crystalline solid menthol particles.

The solid menthol particles may have an average particle size of, for example, between about 50 micrometers and about 900 micrometers.

Solid menthol particles suitable for use in flavor release segments according to the invention are commercially available from, for example, Symrise AG, Germany and Takasago International Corporation, Japan.

Flavour release segments according to the invention having different dimensions may be produced depending upon their intended use.

Flavour release segments according to the invention may have an external diameter of, for example, between about 5 mm and about 8.5 mm.

Flavour release segments according to the invention may have a length of, for example, between about 3 mm and about 120 mm.

Flavour release segments according to the invention for use in mouthpieces of smoking articles may have a length of, for example, between about 3 mm and about 30 mm.

Randomly oriented fibres for use in flavour release segments according to the invention can be made using various processes known in the art such as dry laid or wet laid processes including point bound, spun bound, needle felt, needle punch and suspension in water. Suitable processes and machinery for making plugs of fibrous material including randomly oriented fibres for use in flavour release segments according to the invention are well known in the art. For example, filter elements comprising randomly oriented fibres and methods for their manufacture are described in WO-A-2009/093051 and filters comprising randomly oriented fibres are commercially available from Filtrona, UK under the trade name Randomly Oriented Acetate™ filter.

The solid menthol particles may be dispersed in the plug of fibrous material of flavour release segments according to the invention using known processes and machinery for manufacturing carbon-on-tow filter segments comprising a plug of cellulose acetate tow or other fibrous filtration material with a plurality of carbon particles distributed therein.

Mouthpieces according to the invention may be single segment mouthpieces or filters, consisting of the flavour release segment only.

Alternatively, mouthpieces according to the invention may be multi-component mouthpieces or filters comprising one or more segments in addition to the flavour release segment.

Mouthpieces according to the invention may comprise one or more segments upstream of the flavour release segment.

Alternatively or in addition, mouthpieces according to the invention may comprise one or more segments downstream of the flavour release segment For example, mouthpieces according to the invention may comprise a mouth end segment downstream of the flavour release segment. This advantageously prevents solid menthol particles distributed in the plug of fibrous material of the flavour release segment coming into direct contact with a consumer's mouth.

As used herein, the terms 'upstream' and 'downstream' are used to describe the relative position of portions or components of mouthpieces and smoking articles according to the invention in relation to the direction of mainstream smoke drawn through the mouthpieces and smoking articles during use thereof. For example, in a mouthpiece where the flavour release segment is upstream of a mouth end segment, mainstream smoke is drawn first through the flavour release segment and then through the mouth end segment.

Mouthpieces according to the invention may comprise one or more additional segments comprising fibrous filtration material, such as cellulose acetate tow. Alternatively or in addition, multi-component mouthpieces according to the invention may comprise one or more additional segments comprising a hollow tube, cavity or recess.

For example, mouthpieces according to the invention may comprise a mouth end segment downstream of the flavour release segment, wherein the mouth end segment comprises a plug of cellulose acetate tow or other fibrous filtration material. Alternatively, mouthpieces according to the invention may comprise a mouth end segment downstream of the flavour release segment, wherein the mouth end segment comprises a hollow tube, cavity or recess.

Mouthpieces according to the invention may include one or more additional segments comprising sorbents (for example, activated carbon or silica gel), plant material (for example, tobacco lamina), flavourants, other smoke modifying agents and combinations thereof.

The one or more additional segments may be used to achieve a desired overall plasticiser content in the mouthpiece.

Alternatively or in addition, the one or more additional segments may be used to achieve a desired overall resistance to draw (RTD) of the mouthpiece.

Mouthpieces according to the invention may have a resistance to draw (RTD) of, for example, between about 100 mm WG (water gauge) and about 180 mm WG as measured in accordance with ISO 6565:2002.

Mouthpieces according to the invention may have an external diameter of, for example, between about 5 mm and about 8.5 mm.

Mouthpieces according to the invention may have a length of, for example, between about 20 mm and about 50 mm.

Where mouthpieces according to the invention comprise a mouth end segment downstream of the flavour release segment, the length of the mouth end segment may be, for example, between about 3 mm and about 15 mm, for example between about 6 mm and about 12 mm.

Where the mouth end segment comprises a hollow tube or recess, the length of the mouth end segment may be, for example, between about 3 mm and about 8 mm.

Mouthpieces according to the invention may be incorporated into a wide variety of different types of smoking articles. For example, mouthpieces according to the invention may be incorporated into combustible smoking articles, such as filter cigarettes, comprising a wrapped rod of tobacco cut filler or other smokable material, which is combusted during smoking.

Alternatively, mouthpieces according to the invention may be incorporated into non-combustible, heated smoking articles of the type described above in which material is heated to form an aerosol, rather than combusted. For example, mouthpieces according to the invention may be incorporated into heated smoking articles comprising a combustible heat source and an aerosol-generating substrate downstream of the combustible heat source, such as that disclosed in WO-A-2009/022232. Mouthpieces according to the invention may also be incorporated into heated smoking articles comprising non-combustible heat sources, for example chemical heat sources or electrical heat sources.

Alternatively, mouthpieces according to the invention may be incorporated into non combustible smoking articles of the type described above in which an aerosol is generated from an aerosol generating substrate without combustion or heating, such as those described in WO-A-2008/121610 and WO-A-2010/107613.

Smoking articles according to the invention may comprise a flavour release segment according to the invention in any portion thereof.

For example, combustible smoking articles according to the invention may comprise a wrapped rod of smokable material, wherein the wrapped rod of smokable material comprises or consists of the flavour release segment. In such embodiments, the flavour release segment may comprise a plug of fibrous smokable material and a plurality of solid menthol particles distributed within the plug of fibrous smokable material, wherein the fibrous smokable material comprises randomly oriented fibres.

Alternatively, combustible and non-combustible smoking articles according to the invention may comprise a mouthpiece, wherein the mouthpiece comprises or consists of the flavour release segment. In such embodiments, the flavour release segment may comprise a plug of fibrous filtration material and a plurality of solid menthol particles distributed within the plug of fibrous filtration material, wherein the fibrous filtration material comprises randomly oriented fibres.

Smoking articles according to the invention preferably comprise a mouthpiece, wherein the mouthpiece comprises the flavour release segment.

In one embodiment, smoking articles according to the invention may comprise a wrapped rod of tobacco cut filler or other smokable material attached to the mouthpiece by a band of tipping paper.

Preferably, the flavour release segment in the mouthpiece abuts the wrapped rod of smokable material.

In another embodiment, smoking articles according to the invention may comprise an aerosol generating substrate upstream of the mouthpiece.

The amount of menthol released from the flavour release segment into mainstream smoke drawn through smoking articles according to the invention when smoked in accordance with ISO 15592-3:2008 may be between, for example, about 1% and about 15% of the weight of the plurality of solid menthol particles distributed within the plug of fibrous material.

When smoked in accordance with ISO 15592-3:2008, smoking articles according to the invention may provide a total menthol delivery of, for example, between about 0.1 mg and about 3 mg as measured in accordance with draft ISO/TC 126 N 1076 entitled "Cigarettes—Determination of menthol in smoke condensates—Gas-chromatographic method" dated 2011 Mar. 21. In this test method, the total particulate matter from the mainstream smoke is dissolved in a solvent (propan-2-ol) containing an internal standard (n-heptadecane). The menthol content of an aliquot of the solution is determined by gas chromatography, and the menthol content of the total particulate matter of the mainstream smoke is calculated.

Smoking articles according to the invention may comprise mouthpieces with ventilation in order to mix ambient air with mainstream drawn through the mouthpiece by a consumer during smoking. For example, one or more circumferential rows of perforations may be provided at a location along the mouthpiece in order to mix ambient air with mainstream drawn through the mouthpiece by a consumer during smoking. Preferably, the one or more circumferential rows of perforations or other ventilation is located at least 12 mm from the mouth end of the mouthpiece.

Smoking articles according to the invention may have a ventilation level of, for example, between about 20% and about 80%, as measured in accordance with ISO 9512:2002.

Smoking articles according to the invention may have an overall length of, for example, between about 60 mm and about 128 mm.

Smoking articles according to the invention may have an external diameter of, for example, between about 5 mm and about 8.5 mm, for example between about 5 mm and about 7.1 mm for slim sized smoking articles or between about 7.1 mm and about 8.5 mm for regular sized smoking articles.

Figure 2:
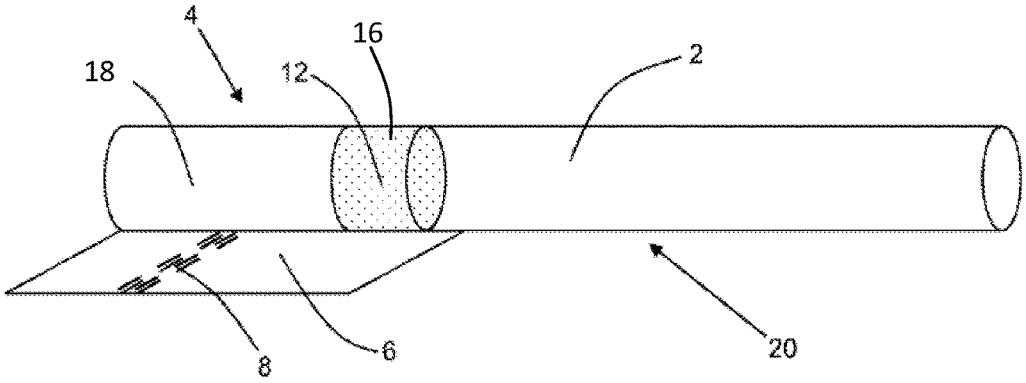

The invention will be further described, by way of example only, with reference to the accompanying drawings, in which:

FIG. 1 shows a side view of a smoking article according to a first embodiment of the invention comprising a single segment filter; and FIG. 2 shows a side view of a smoking article according to a second embodiment of the invention comprising a multi-segment filter.

The smoking articles shown in FIGS. 1 and 2 have several components in common and these components have been given the same reference numerals. In FIGS. 1 and 2, portions of the smoking articles have been broken away to illustrate interior details of the smoking articles.

Each smoking article generally comprises an elongate cylindrical tobacco rod (aerosol generating substrate) 2 wrapped with wrapper 22 and attached at one end to an axially aligned, elongate cylindrical mouthpiece 4. The tobacco rod 2 and the mouthpiece 4 are joined in a conventional manner by a band of tipping paper 6 which may or may not be transparent. The tipping paper circumscribes the entire length of the mouthpiece and an adjacent portion of the wrapped tobacco rod 2. A plurality of annular perforations are provided through the tipping paper 6 at a location along the mouthpiece 4 to mix ambient air with mainstream smoke produced during combustion of the tobacco 2.

As shown in FIG. 1, the mouthpiece 4 of the smoking article 10 according to the first embodiment of the invention is a single segment filter consisting of a flavour release segment 12 adjacent to and abutting the tobacco rod 2. The flavour release segment 12 comprising a plug of pre-cut, randomly oriented cellulose acetate fibres 14 (schematically shown in FIG. 1) with a plurality of solid crystalline menthol particles 16 substantially evenly distributed therein. The plug of randomly oriented cellulose acetate fibres does not contain any plasticiser and is circumscribed by a non-porous, air impermeable, transparent cellulosic film wrapper 24 (indicated by dashed lines).

As shown in FIG. 2, the mouthpiece 4 of the smoking article 20 according to the second embodiment of the invention is a multi-segment filter that comprises two segments in an abutting end-to-end relationship, a flavour release segment 12 adjacent to and abutting the wrapped tobacco rod 2 and a mouth end segment 18 downstream from the flavour release segment. The flavor release segment 12 is of the same construction as that previously described above for the smoking article 10 according to the first embodiment of the invention shown in FIG. 1. The mouth end segment comprises a plug of axially oriented cellulose acetate fibres. The plug of axially oriented cellulose fibres contains a plasticiser, such as triacetin, and is circumscribed by a porous, air permeable, plug wrap.

During smoking of the smoking articles 10, 20 according to the first and second embodiments of the invention shown in FIGS. 1 and 2, mainstream smoke is drawn downstream from the lit end of the wrapped tobacco rod 2 through the mouthpiece 4 by the consumer. As the mainstream smoke enters the mouthpiece 4 it passes through the flavour release segment 12 abutting the wrapped tobacco rod 2. The temperature of the mainstream smoke as it enters the flavour release segment is typically between about 30 and about 50 degrees Celsius. As the mainstream smoke passes through the flavour release segment 12, heat transfer from the mainstream smoke to the plurality of solid crystalline menthol particles distributed in the plug of randomly oriented cellulose acetate fibres causes menthol in the solid crystalline menthol particles to sublime and become entrained in the mainstream smoke.

In the first embodiment of the invention shown in FIG. 1, the mainstream smoke comprising the menthol released from the plurality of solid crystalline menthol particles distributed in the plug of randomly oriented cellulose acetate fibres of the flavour release segment 12 passes directly into the consumer's mouth from the mouth end of the flavour release segment 12.

In the second embodiment of the invention shown in FIG. 2, the mainstream smoke comprising the menthol released from the plurality of solid crystalline menthol particles distributed in the plug of randomly oriented cellulose acetate fibres passes downstream through the mouth end segment 14 before entering the consumer's mouth.

To form the smoking articles 10, 20 according to the first and second embodiments of the inventions shown in FIGS. 1 and 2, the mouthpieces 4 are produced and then attached to the wrapped tobacco rods 2, which are produced in a conventional manner, using known filter cigarette making machinery.

To produce the mouthpiece 4 of the smoking article 20 according to the second embodiment of the invention shown in FIG. 2, separate continuous rods comprising multiple units of each segment 12, 14 of the multi-component filter are produced and then combined to form a continuous filter rod comprising multiple units of the multi-segment filter 4. The continuous filter rod is then severed at regular intervals to yield a succession of discrete multi-component filters 4.

EXAMPLE

A filter cigarette with a single segment filter according to the first embodiment of the invention shown in FIG. 1 was produced having the dimensions and properties given in Table 1 below.

Analysis results for the mainstream smoke of the smoking article when smoked in accordance with ISO 15592-3:2008 are shown in Table 2 below.

TABLE 1

| | |
|---|---|
| Smoking article | |
| Length (mm) | 84 |
| External Diameter (mm) | 7.85 |
| RTD (mm WG) | 115 |
| Wrapped Tobacco Rod | |
| Length (mm) | 57 |
| RTD (mm WG) | 40 |
| Mouthpiece | |
| Length (mm) | 27 |
| RTD (mm WG) | 110 |
| Ventilation: number of circumferential lines of perforations | 2 |
| Ventilation: number of perforations (per line) | 12 |
| Ventilation: distance from mouth end (mm) | 12 |
| Ventilation: level (%) | 33 |
| Flavour Release Segment: | |
| Length (mm) | 27 |
| External Diameter (mm) | 7.8 |
| Cellulose acetate fibres: cross section | Y |
| Cellulose acetate fibres: denier per filament | 8.0 |
| Cellulose acetate fibres: total denier | 28000 |
| Cellulose acetate fibres: length (mm) | 10 |
| Crystalline menthol particles: average loading (mg/mm) | 0.68 |
| Crystalline menthol particles: total loading (mg) | 18.36 |

TABLE 2

| | |
|---|---|
| Total nicotine free dry particulate matter (tar) | 5.1 mg |
| Smoke nicotine | 0.40 mg |
| Carbon monoxide | 8.9 mg |
| Menthol | 0.56 mg |

While the invention has been exemplified above with reference to combustible smoking articles, it will be appreciated that flavour release segments according to the invention may also be included in non-combustible smoking articles.

The invention claimed is:

1. A smoking article comprising a flavour release segment, the flavour release segment comprising:

a plug of fibrous filtration material circumscribed by a substantially air impermeable wrapper having an air permeability of less than 20 Coresta units as measured in accordance with ISO 2965:2009; and a plurality of solid menthol particles distributed within the plug of fibrous filtration material, wherein the fibrous filtration material comprises randomly oriented fibres and is free of plasticizer;

wherein an average of between 0.1 milligrams and 1 mg of solid menthol particles are distributed within the plug of fibrous filtration material per millimeter length thereof.

2. A smoking article according to claim 1 wherein the plug of fibrous filtration material is circumscribed by a substantially air impermeable transparent wrapper.

3. A smoking article according to claim 1 wherein the plug of fibrous filtration material is circumscribed by a substantially air impermeable film wrapper having an oxygen gas transmission rate ($O_2$GTR) of less than 5 $cm^3$ (STP)/$m^2$·24 hours at a pressure differential of 1 atmosphere as measured in accordance with ASTM F1297-07 at 23° C. and 0% relative humidity (RH).

4. A smoking article according to claim 1 wherein the plug of fibrous filtration material is a plug of cellulose acetate tow.

5. A smoking article according to claim 1 wherein the average particle size of the plurality of solid menthol particles is between 50 micrometers and 900 micrometers.

6. A smoking article according to claim 1 comprising a mouthpiece, wherein the mouthpiece comprises the flavour release segment.

7. A smoking article according to claim 6 further comprising a wrapped rod of smokable material attached to the mouthpiece by tipping paper.

8. A smoking article according to claim 7 wherein the flavour release segment abuts the wrapped rod of smokable material.

9. A smoking article according to claim 7 wherein the amount of menthol released from the plurality of solid menthol particles of the flavour release segment when the smoking article is smoked in accordance with ISO 15592-3.2008 is between 1% and 15% of the weight of the plurality of solid menthol particles distributed within the plug of fibrous filtration material.

10. A smoking article according to claim 7 wherein the total amount of menthol released from the plurality of solid menthol particles of the flavour release segment when the smoking article is smoked in accordance with ISO 15592-3:2005 is between 0.1 mg and 3 mg.

11. A smoking article according to claim 6 further comprising an aerosol generating substrate upstream of the mouthpiece.

12. A smoking article according to claim 6 wherein the mouthpiece further comprises a mouth end segment downstream of the flavour release segment.

13. A smoking article according to claim 1 wherein the average particle size of the plurality of solid menthol particles is between 50 micrometers and 900 micrometers.

14. A smoking article according to claim 8 wherein the amount of menthol released from the plurality of solid menthol particles of the flavour release segment when the smoking article is smoked in accordance with ISO 15592-3: 2008 is between 1% and 15% of the weight of the plurality of solid menthol particles distributed within the plug of fibrous filtration material.

15. A mouthpiece for a smoking article comprising a flavour release segment, the flavour release segment comprising:

a plug of fibrous filtration material circumscribed by a substantially air impermeable wrapper having an air permeability of less than 20 Coresta units as measured in accordance with ISO 2965:2009; and a plurality of solid menthol particles distributed within the plug of fibrous filtration material, wherein the fibrous filtration material comprises randomly oriented fibres and is free of plasticizer;

wherein an average of between 0.1 milligrams and 1 mg of solid menthol particles are distributed within the plug of fibrous filtration material per millimeter length thereof.

16. A mouthpiece according to claim 15 wherein the plug of fibrous filtration material is circumscribed by a substantially air impermeable film wrapper having an oxygen gas transmission rate ($O_2$GTR) of less than about 5 $cm^3$ (STP)/$m^2$·24 hours at a pressure differential of 1 atmosphere as measured in accordance with ASTM F1297-07 at 23° C. and 0% relative humidity (RH).

* * * * *